US008276784B2

(12) United States Patent
Ciavarella et al.

(10) Patent No.: US 8,276,784 B2
(45) Date of Patent: Oct. 2, 2012

(54) PRESSURE ACTIVATED AUTOMATIC SOURCE SWITCHING DISPENSER SYSTEM

(75) Inventors: Nick E. Ciavarella, Seven Hills, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 964 days.

(21) Appl. No.: 12/316,362

(22) Filed: Dec. 11, 2008

(65) Prior Publication Data

US 2010/0147881 A1 Jun. 17, 2010

(51) Int. Cl.
*B67D 1/04* (2006.01)

(52) U.S. Cl. ..... 222/66

(58) Field of Classification Search ..... 222/190, 222/66–69, 214, 135, 14, 325; 137/113, 137/206, 209

See application file for complete search history.

(56) References Cited

U.S. PATENT DOCUMENTS

| | | | | |
|---|---|---|---|---|
| 2,979,070 | A * | 4/1961 | Payne | 137/192 |
| 3,587,927 | A * | 6/1971 | Stott | 222/66 |
| 4,317,530 | A * | 3/1982 | Magrath | 222/309 |
| 5,242,081 | A | 9/1993 | van der Heyden et al. | |
| 7,615,010 | B1 * | 11/2009 | Najafi et al. | 600/481 |

FOREIGN PATENT DOCUMENTS

WO 99/49769 10/1999

* cited by examiner

*Primary Examiner* — Kevin P Shaver
*Assistant Examiner* — Robert Nichols, II
(74) *Attorney, Agent, or Firm* — Renner Kenner Greive Bobak Taylor & Weber

(57) ABSTRACT

A dispenser includes a housing that holds first and second refill units, each including a product container and a valve assembly that receives product from the product container. An actuator mechanism associates with the first refill unit and is actuated to force air into the associated valve assembly and dispense product from the valve assembly until such time as the product container associated with that valve assembly is empty. When empty, a float valve of the valve assembly prevents the actuation of the actuator mechanism and forces the actuator mechanism to associate with the second refill unit. While so associated, the first refill unit can be replaced, thus, helping to ensure that the dispenser does not run out of product.

8 Claims, 9 Drawing Sheets

PRESSURE ACTIVATED AUTOMATIC SOURCE SWITCHING DISPENSER SYSTEM

FIELD OF THE INVENTION

The present invention generally relates to wall-mounted dispensers. In particular embodiments, the present invention relates to a wall-mounted dispenser having two refill units containing liquid product for dispensing. An actuator mechanism associated with a push bar of the dispenser serves to automatically switch from association with an empty refill unit to association with a non-empty refill unit. While the actuator mechanism is associated with a non-empty refill unit, the empty refill unit may be replaced.

BACKGROUND OF THE INVENTION

Wall-mounted dispensers for liquid products are well-known in the art. Typically, they include a wall-mounted housing that can be opened to receive liquid product containers. Many times, these liquid product containers are part of a refill unit that includes the product container and a pump mechanism. Once placed in the housing, an actuator mechanism, often a push bar or a electronic system actuated by a proximity sensor, can be manipulated to actuate the pump and cause a dose of the liquid product to be dispensed to the user's hand.

For customer satisfaction, it is important that such wall-mounted dispensers do not go empty. Thus, it is necessary to periodically replace an empty or near-empty product container/refill unit. Such periodic replacement demands maintenance time. The maintenance time and frequency of maintenance visits may be minimized by attending to the replacement of all near-empty containers/refill units during a given maintenance visit. But replacing a near-empty container with a new, full container, while being effective in preventing the occurrence of an empty dispenser, results in waste of the product still remaining in the near-empty container. Thus, though maintenance time may be saved by replacing all near-empty containers/refill units during a given maintenance visit, the cost of the wasted product must be weighed against the potential savings in maintenance time. At any rate, the dispensing systems would benefit from more consistently providing a dispenser that contains product.

To address this problem, some dispensers are configured to hold two or more refill units at one time. However, it is typically necessary to pull a lever or turn a knob in order to switch the actuator mechanism from association from one refill to associate with the other. As a result, these dispensers have not been commercially successful because they are not received well by the end users, who must know what to do to switch from an empty container to a non-empty container. Thus, a need exists in the art for a dispenser that can receive two refill units and that provides an actuator mechanism that automatically switches from an empty refill unit to a non-empty refill unit.

One area of liquid dispensing that is quite popular is soap and sanitizer dispensing. In recent years, it has become popular to dispense soap and sanitizer products as foam, wherein a liquid soap or liquid or gel sanitizer is mixed with air. To dispense the liquid product as a foam, both a liquid pump and an air pump are typically employed, and, in the case of a refill unit carrying the pump mechanisms, it is common to provide both the air pump and the liquid pump as part of the refill unit. Thus, the need for a dispenser that automatically switches between an empty and a non-empty refill unit would also benefit by being capable of dispensing the product in the refill unit as a foam. Further benefits might be realized by providing an air pump portion as part of the dispenser, thus permitting the refill units to simply hold liquid pumping mechanisms.

SUMMARY OF THE INVENTION

In accordance with one embodiment of this invention a refill unit is provided for receipt in a product dispenser. The refill unit includes a container that holds a liquid product for dispensing, and a foam generating valve. The foam generating valve includes a valve body, and a holding chamber is provided in the valve body. An air inlet permits fluid communication between a source of pressurized air and the holding chamber. An air inlet valve is biased by a biasing mechanism to block the air inlet, and is movable against the biasing force of the biasing mechanism by pressurized air introduced through the air inlet. A liquid inlet provides fluid communication between the liquid product in the container and the holding chamber, and a liquid inlet float valve floats on liquid product in the holding chamber. The liquid inlet float valve sinks with the level of the liquid product in the holding chamber and blocks movement of the air inlet valve against the biasing force of the biasing mechanism when it sinks to a valve-blocking level.

In another embodiment, this invention provides a dispenser. The dispenser includes a housing and first and second containers removably received in the housing, each holding product for dispensing. A first valve assembly fluidly communicates with and receives product from the first container, and a second valve assembly fluidly communicates with and receives product from the second container. The first valve assembly includes a first liquid inlet float valve, and the second valve assembly includes a second liquid inlet float valve. A valve assembly actuator mechanism is mounted to the housing to selectively fluidly communicate with the first valve assembly and the second valve assembly. When the valve assembly actuator mechanism fluidly communicates with the first valve assembly, actuation of the valve assembly actuator mechanism causes product to be dispensed through the first valve assembly, and the valve assembly actuator mechanism remains in fluid communication with the first valve assembly until such time as the first container is substantially empty of product. The emptying of the first container causes the first float valve to block the fluid communication between the valve assembly actuator mechanism and the first container, such that, when the first container is empty, actuation of the valve assembly actuator mechanism causes it to move to fluidly communicate with the second valve assembly.

DETAILED DESCRIPTION OF ILLUSTRATIVE EMBODIMENTS

Figure 1:
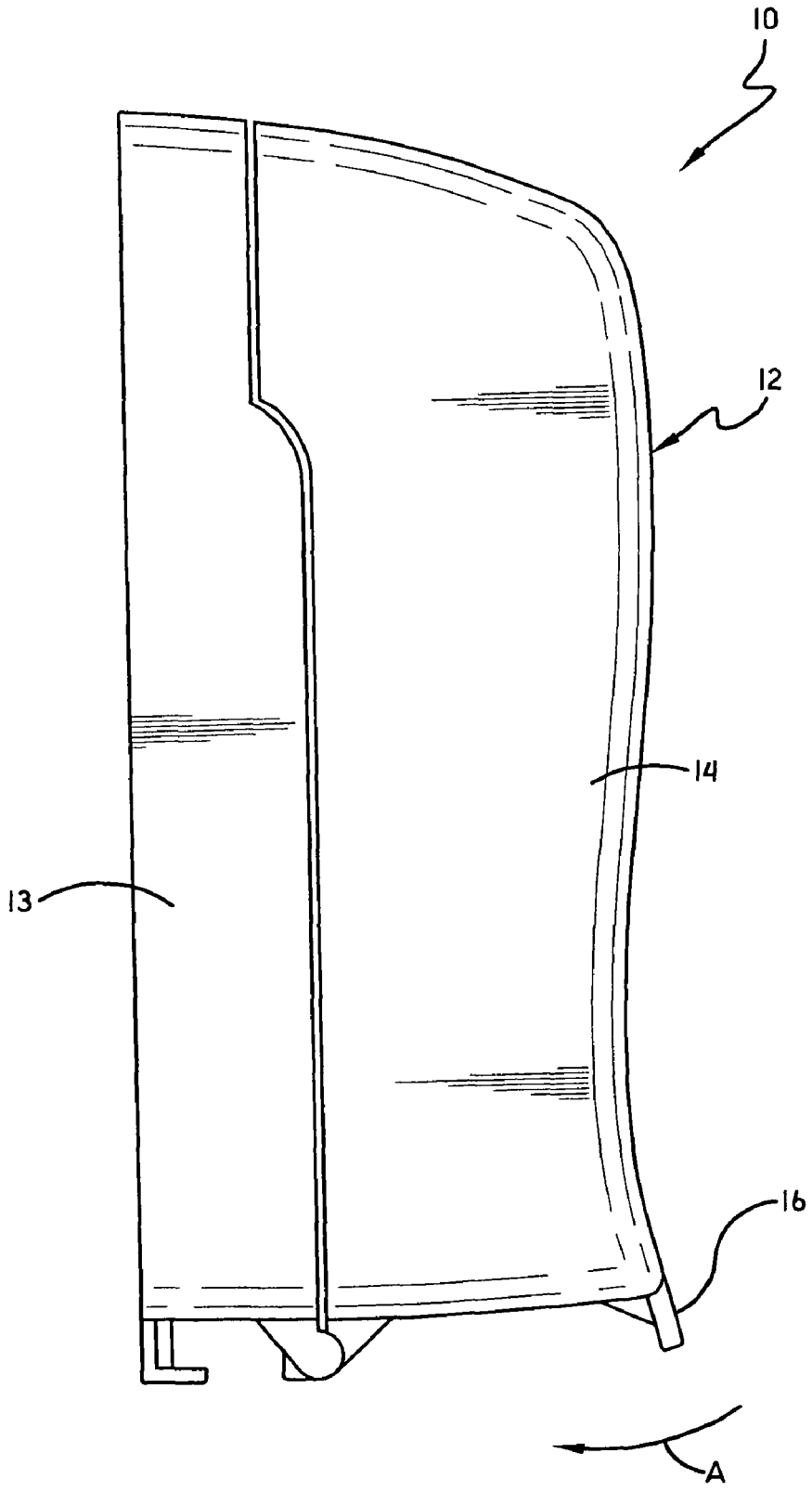
FIG. 1 is a side elevation view of a closed dispenser in accordance with this invention.

Referring now to FIG. 1, the exterior of a dispenser in accordance with this invention is shown and designated by the numeral ten. The dispenser 10 includes a housing 12 including a back plate 13 to which is hingedly connected a cover 14. The cover 14 carries a push bar 16, which is pushed in the direction of arrow A to dispense product to an outlet in a dispensing tube positioned behind the push bar 16. A user will generally contact the push bar 16 with the palm of the hand, such that the product dispensed will fall into the hand.

Figure 2:
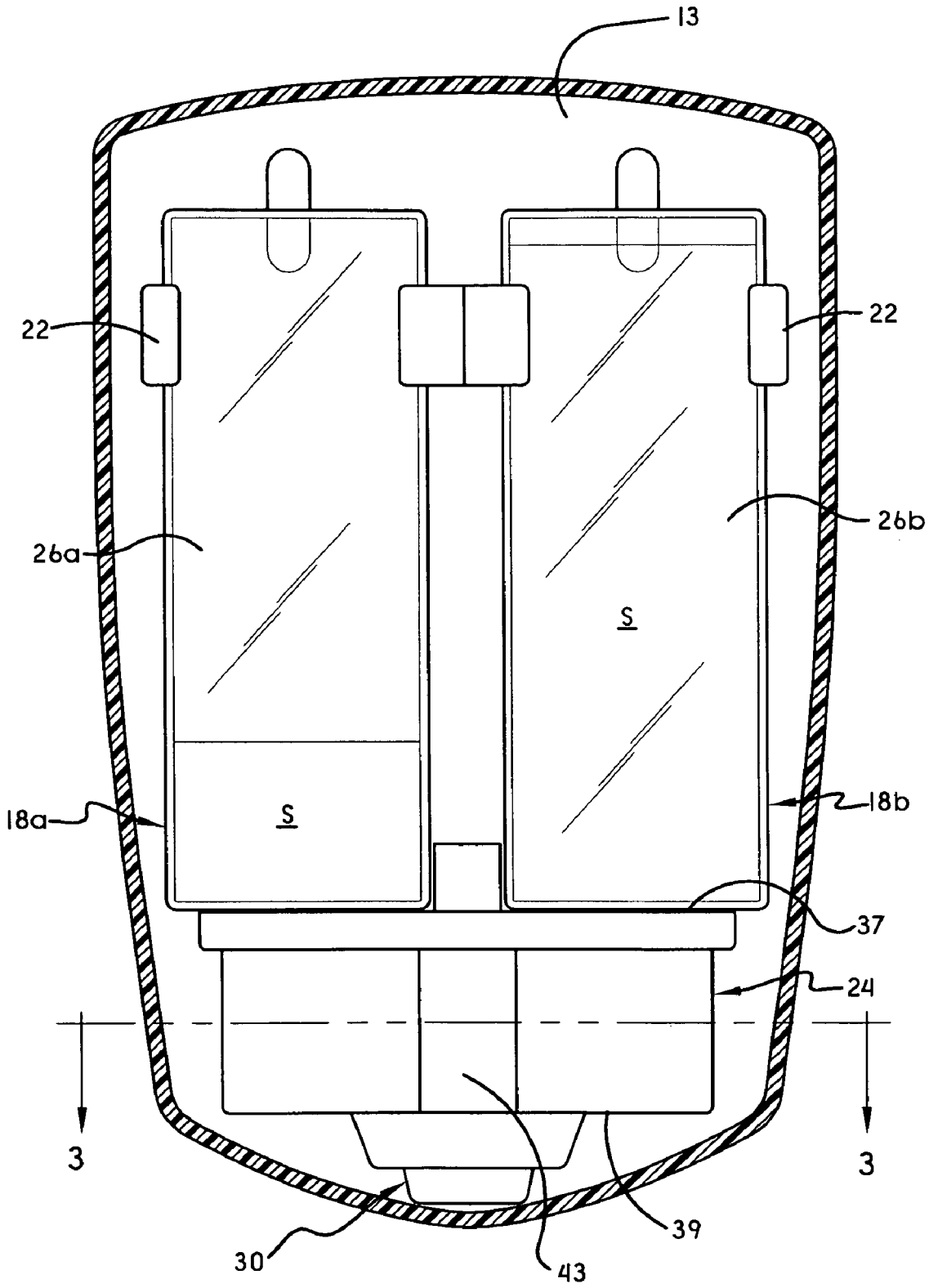
FIG. 2 is a front elevation view of the dispenser, shown with a cover removed.
Figure 4:
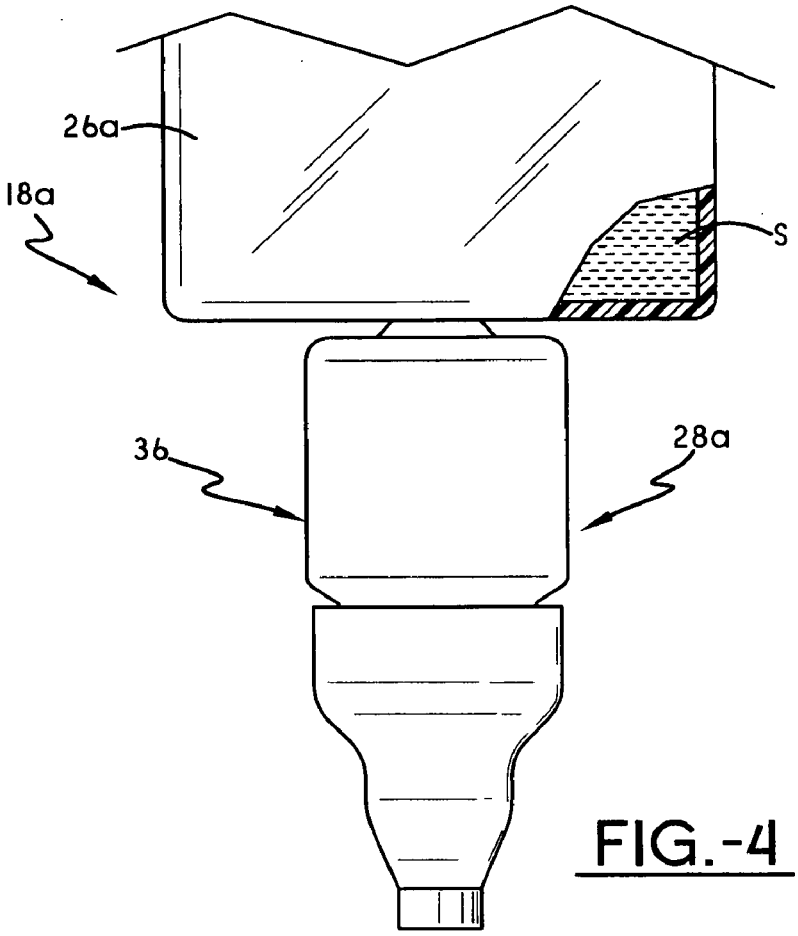
FIG. 4 is a side elevation view of a refill unit in accordance with this invention.

Referring now to FIG. 2, the cover 14 is removed, and it can be seen that the dispenser 10 holds a first refill unit 18*a* and a second refill unit 18*b*, which are both supported on a ledge (not shown) and/or held by clips 22 on back plate 13. Each one of the first and second refill units 18*a*, 18*b* is positioned in the dispenser 10 so that it may interact with a valve assembly actuator mechanism 24. It should be appreciated that the first and second refill units 18*a*, 18*b* can be, and preferably are, identical inasmuch as that will facilitate the manufacturing of refill units. Thus, with reference to FIG. 4, the first refill unit 18*a* is shown, with the understanding that the second refill unit 18*b* is structurally and functionally similar, if not identical. First refill unit 18*a* includes a container 26*a* holding a foamable liquid S to be dispensed from the container 26*a* upon actuation of the dispenser 10. A foam generating valve assembly 28*a* is associated with the container 26*a* to fluidly communicate with the foamable liquid S in the container 26*a*.

Figure 3:
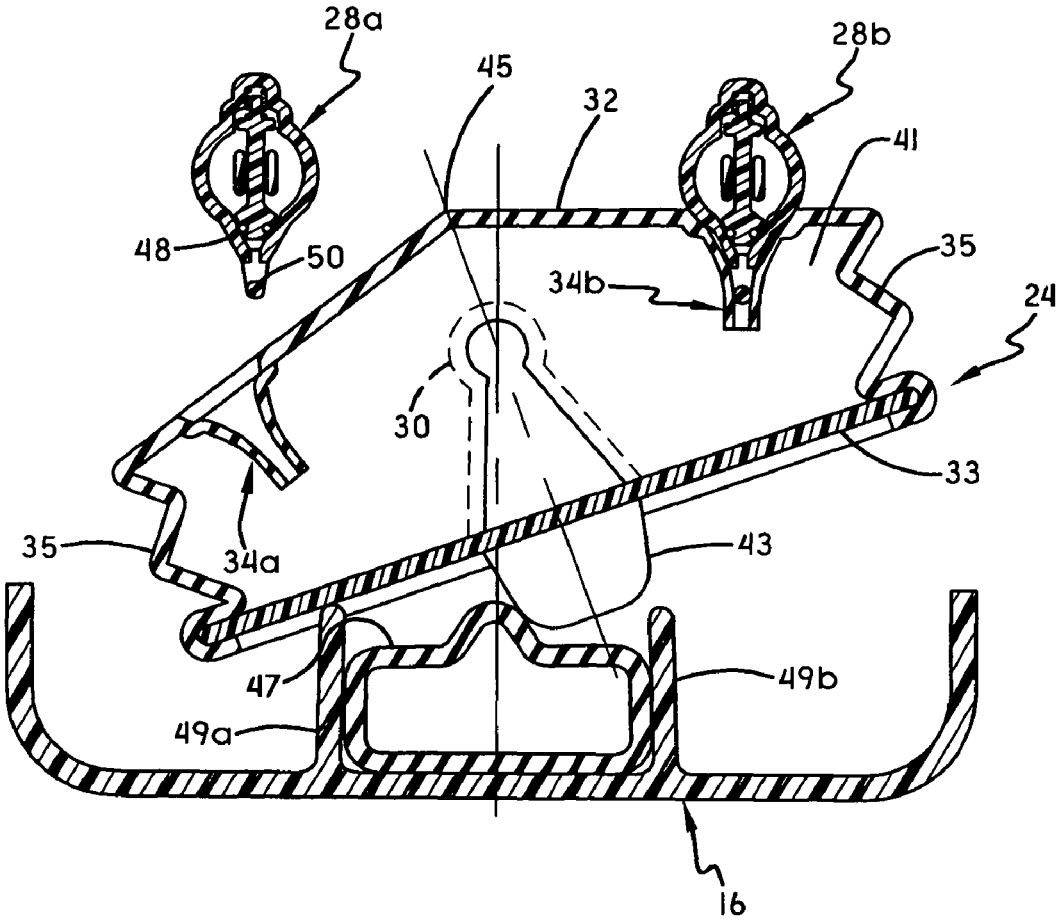
FIG. 3 is a cross section of the dispenser, taken along the line 3-3 of FIG. 2, and shown with a push bar actuator mechanism added and in the non-actuated rest position.

As seen in FIG. 3, the valve assembly actuator mechanism 24 is pivotally connected to the back plate 13 (or the bottom wall extending from the back plate) at a pivot structure 30 which may be a bearing and journal structure. The valve assembly actuator mechanism 24 is shown associated with the foam generating valve assembly 28*b* of the second refill unit 18*b*. The valve assembly actuator mechanism 24 includes a rear wall 32 having a first outlet valve 34*a* and a second outlet valve 34*b* positioned to selectively engage the foam generating valve assemblies 28*a* and 28*b* respectively.

The rear wall 32 is joined to a front wall 33 by collapsible sidewalls 35, such that the front wall 33 can be pushed toward the rear wall 32. The top wall 37 and bottom wall 39 (FIG. 2) are also configured to permit movement of the front wall 33 toward the rear wall 32. In a particular embodiment, the top wall 37, the bottom wall 39 and the sidewalls 35 are all one integral bellows member. A collapsible air chamber 41 is defined between the top, bottom, front, rear and side walls. The volume of the collapsible air chamber 41 can be decreased to a compressed volume (FIG. 8) by movement of the front wall toward the rear wall 32, and can be increased to an expanded volume (FIG. 3) by movement of the front wall 33 away from the rear wall 32.

Figure 10:
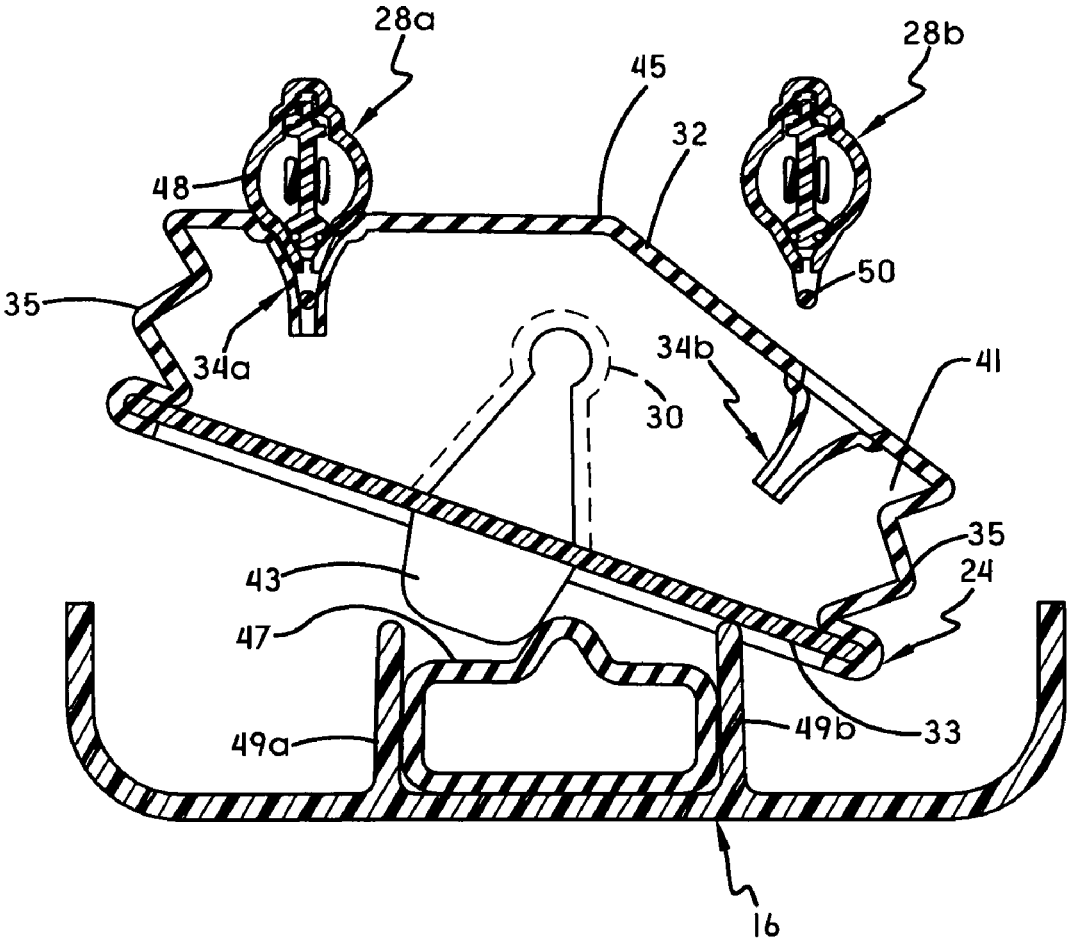
FIG. 10 is a cross section as in FIGS. 3 and 9, shown with the push bar pivoted to associate the valve assembly actuator mechanism with the refill unit on the left of the Figure, the refill unit being full or partially full.

An actuator knob 43 extends from the front wall 33 toward the pushbar 16, and is laterally aligned with the pivot structure 30. Preferably, the valve assembly actuator mechanism 24 is symmetrical, with the pivot structure 30 and actuator knob 43 being positioned at the lateral middle of the valve assembly actuator mechanism 24. The rear wall 32 is angled as at 45, so that the valve assembly actuator mechanism 24 can pivot inward on the right to bring the outlet valve 34*b* into engagement with the foam generating valve assembly 28*b* (FIGS. 3 and 8), and can pivot inward on the left to bring the outlet valve 34*a* into engagement with the foam generating valve assembly 28*a* (FIG. 10). The valve assembly actuator mechanism 24 pivots between such engagement due to its interaction with the structures held by the pushbar 16. These structures include a knob spring 47 positioned between arms 49*a* and 49*b*, and their functioning will be appreciated more particularly upon the disclosure of the operation of the dispenser 10 that is provided later below.

Figure 5:
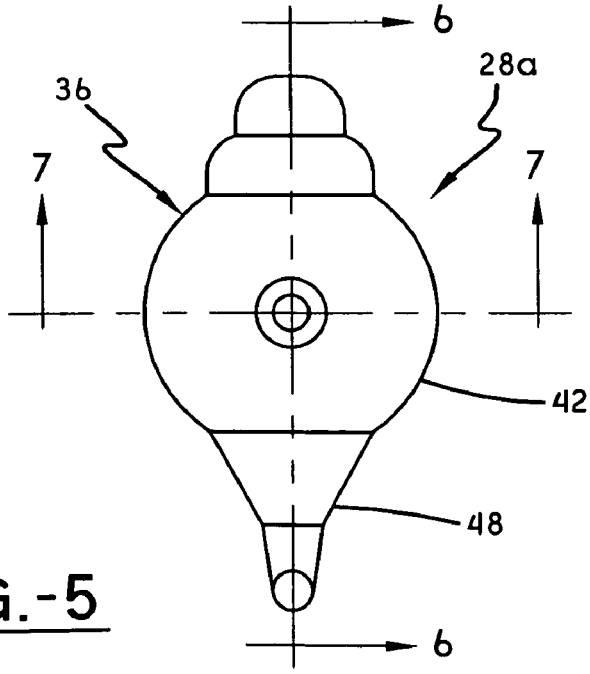
FIG. 5 is a top plan view of a foam generating valve assembly in accordance with this invention.
Figure 7:
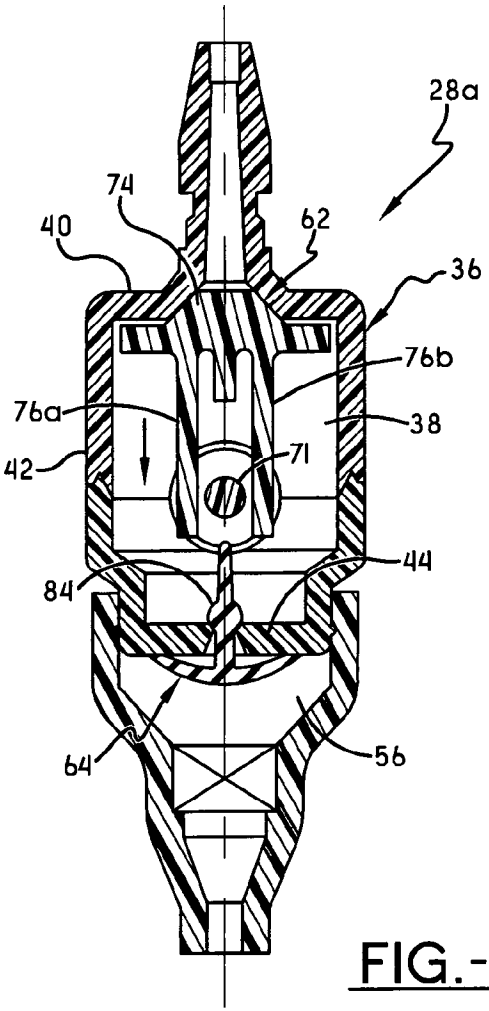
FIG. 7 is a cross sectional view of the valve assembly, taken along the line 7-7.
Figure 6:
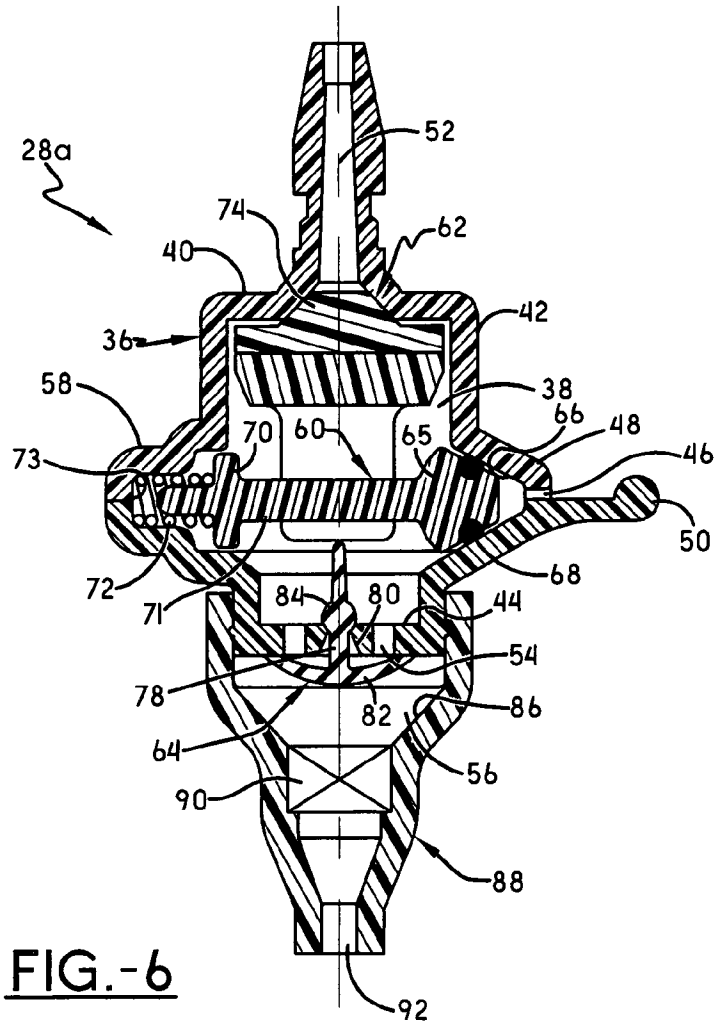
FIG. 6 is a cross section of the valve assembly of FIG. 5, taken along the line 6-6.

In FIGS. 5-7, the foam generating valve assembly 28*a* is shown, it being understood that the foam generating valve assembly 28*b* will preferably be identical. The foam generating valve assembly 28*a* includes a valve body 36 that defines a holding chamber 38 between a top wall 40, at least one side wall 42, and a bottom wall 44. An air inlet 46 is provided in the at least one side wall 42, at a valve engaging extension 48 thereof. In this embodiment, a spreader extension 50 extends from the valve engaging extension 48. A liquid inlet 52 is provided in the top wall 40, and serves to deliver the foamable liquid S from the container 26*a* to the holding chamber 38. Although two are shown, at least one premix outlet 54 is provided in the bottom wall 44, and serves to deliver the contents of the holding chamber into a post mix chamber 56. A valve seat extension 58 is provided in the at least one side wall 42, opposite the valve engaging extension 48, and, as best seen in FIG. 6, an air inlet valve 60 is positioned in the holding chamber 38 between the valve seat extension 58 and the valve engaging extension 48. The holding chamber 38 also retains a liquid inlet float valve 62 that serves to block the liquid inlet 52 and, as will be explained more fully below, block movement of the air inlet valve 60 when an insufficient amount of foamable liquid S is present in the holding chamber 38. A premix outlet valve 64 is also provided at the bottom wall 44 to regulate the flow of a premixture of air and foamable liquid S out of the holding chamber 38 and into the post mix chamber 56.

As seen in FIGS. 3 and 6, the air inlet valve 60 is shaped to intimately contact the interior side wall 66 of the valve engaging extension 48, and an o-ring 68 is secured to valve head 65 to create a liquid-tight seal to prevent liquid in the holding chamber 38 from exiting at the air inlet 46. The valve head 65 is spaced from a base flange 70 by a shaft 71, which is narrower in diameter than the valve head 65. The base flange 70 serves as a contact for a biasing mechanism 72, which is securely received in a seat 73 formed by the valve seat extension 58. Here, the biasing mechanism 72 is shown as a spring, but it should be appreciated that other structures for biasing the air inlet valve 60 in accordance with this invention can be employed. The biasing mechanism 72 is chosen such that air forced into the holding chamber 38 through the air inlet 46 can force the air inlet valve 60 against the biasing mechanism 72, thereby distancing the valve head 65 from the interior side wall 66 to thereby permit the air introduced in this manner to enter the holding chamber 38.

In FIGS. 6 and 7 it can be seen that the liquid inlet float valve 62 has a valve head 74 that is shaped to intimately fit over and block the liquid inlet 52 when positioned against the top wall 40. As its name implies, the liquid inlet float valve 62 is formed from materials suitable to cause it to float on the foamable liquid S being employed in the refill unit 18*a*. Thus, when the holding chamber 38 is filled with foamable liquid S, the liquid inlet float valve 62 is raised to the position shown in FIG. 6 and blocks the liquid inlet 52. As seen in FIG. 7, opposed legs 76*a* and 76*b* extend downwardly from the valve head 74 to span the shaft 71 of the air inlet valve 60. These opposed legs 76*a*, 76*b* not only serve to stabilize the liquid inlet float valve 62, but serve to ensure that the liquid inlet float valve 62 properly sinks and rises in the holding chamber 38 in a proper orientation with respect to the valve head 65 of the inlet valve of the air inlet valve 60, as will be described more fully below during the description of the emptying and refilling of the holding chamber 38 that occurs during the dispensing of product.

The premix outlet valve 64 may be any suitable valve that functions as necessary in accordance with the description provided herein below regarding the functioning of the foam generating valve assembly 28. In this particular embodiment, the premix outlet valve 64 is an umbrella valve having a central shaft 78 extending through an aperture 80 in the bottom wall 44. A flexible flap or umbrella flap 82 extends from the central shaft 78 on the side of the bottom wall 44 that defines a boundary of the post mix chamber 56. This umbrella flap 82 extends to cover the at least one premix outlet 54. This umbrella valve style premix outlet valve 64 can be formed from a suitable flexible material, and may include a shaft bulge 84 serving to retain the premix outlet valve 64 at the aperture 80, absent a force sufficient to force the shaft bulge 84 out through the aperture 80. The post mix chamber 56 is defined between the bottom wall 44 of the valve body 36, and at least one side wall 86 of a dispensing spout 88, and a foam media 90. The dispensing spout 88 provides a foam outlet 92, and the foam media 90 may be positioned virtually at any location between umbrella flap 82 and the foam outlet 92, so long as the umbrella flap is permitted to function. However, it is preferred that there is some distance provided between the umbrella flap 82 and the foam media 90, as shown.

With this general understanding of structure, references is now made to FIGS. 3 and 8-10 to disclose how the dispenser 10 functions to dispense foamable liquid S, as a foam, from a full or partially full container (26*a* or 26*b*) and automatically switch to a full container when the container which it is associated becomes sufficiently empty. In FIG. 3, the valve assembly actuator mechanism 24 is shown associated with the second foam generating valve 28*b* of the second refill unit 18*b*. For purposes of this disclosure, it will be assumed that the second container 26*b* is completely full with foamable liquid S, and that the holding chamber 38 of the second foam generating valve 28*b* is also filled with foamable liquid S. Thus, the liquid inlet float valve 62 floats in the position shown in FIG. 6, blocking the liquid inlet 52. Pressing on push bar 16 causes the spring 47 to push against knob 43, thus forcing front wall 33 toward the rear wall 32. This begins to pressurize the air within the collapsible air chamber 41, and this pressure impinges on the valve head 65, forcing air inlet valve 60 toward and against the biasing mechanism 72, opening valve head 65 off of the interior sidewall 66. As the pushbar 16 is pushed further, the air within the collapsible air chamber 41 is forced into the holding chamber 38. This forces both air and foamable liquid (in the holding chamber 38) in the only direction available, toward and through the premix outlet 54 and out past the umbrella flap 82 of the premix outlet valve 64, into the post mix chamber 56. Air and liquid forced into the post mix chamber 56 are then forced through the foam media 90, and out the outlet 92, though a long length of dispensing tube may be provided between the foam media and the outlet 52, in distinction to the structure shown. Additionally, the dispensing tube may jog over toward the middle of the pushbar so that the product is dispensed closer to the middle of the width of the pushbar rather than at the left-shifted or right-shifted positions of the refill units.

The foam media 90 is simply an element provided to homogenize the coarse mixture of air and liquid introduced into the post mix chamber 56. Typically, the foam media 90 will be a screen or mesh element or an open-celled foam element. In some embodiments, the foam media 90 may be a mixing cartridge, which is simply a tubular member having an inlet mesh and outlet mesh, such that the mixture of air and liquid must pass through both mesh elements before being advanced further through the system, i.e., toward the outlet 92.

Figure 8:
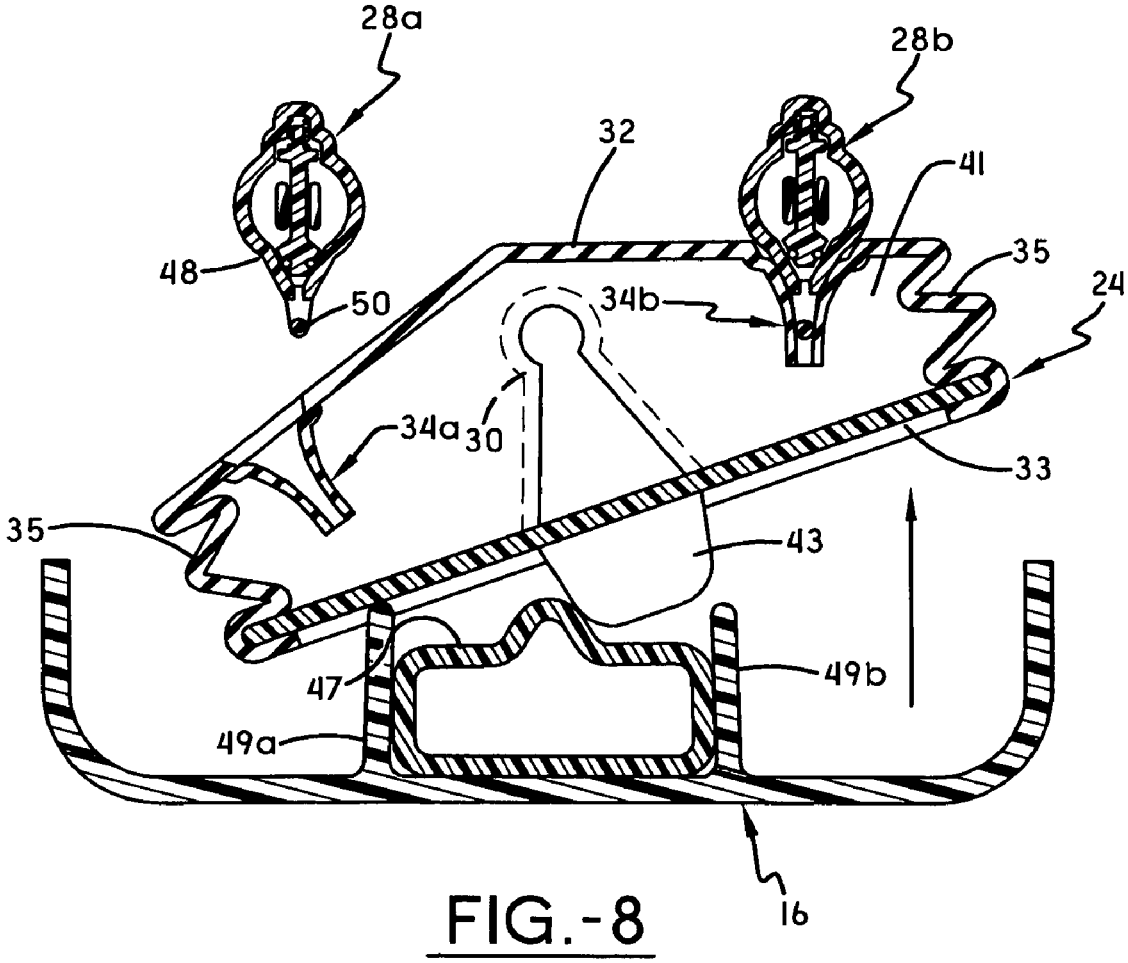
FIG. 8 is a cross section of the dispenser, as in FIG. 3, but shown with the push bar actuator mechanism in the actuated position.
Figure 11:
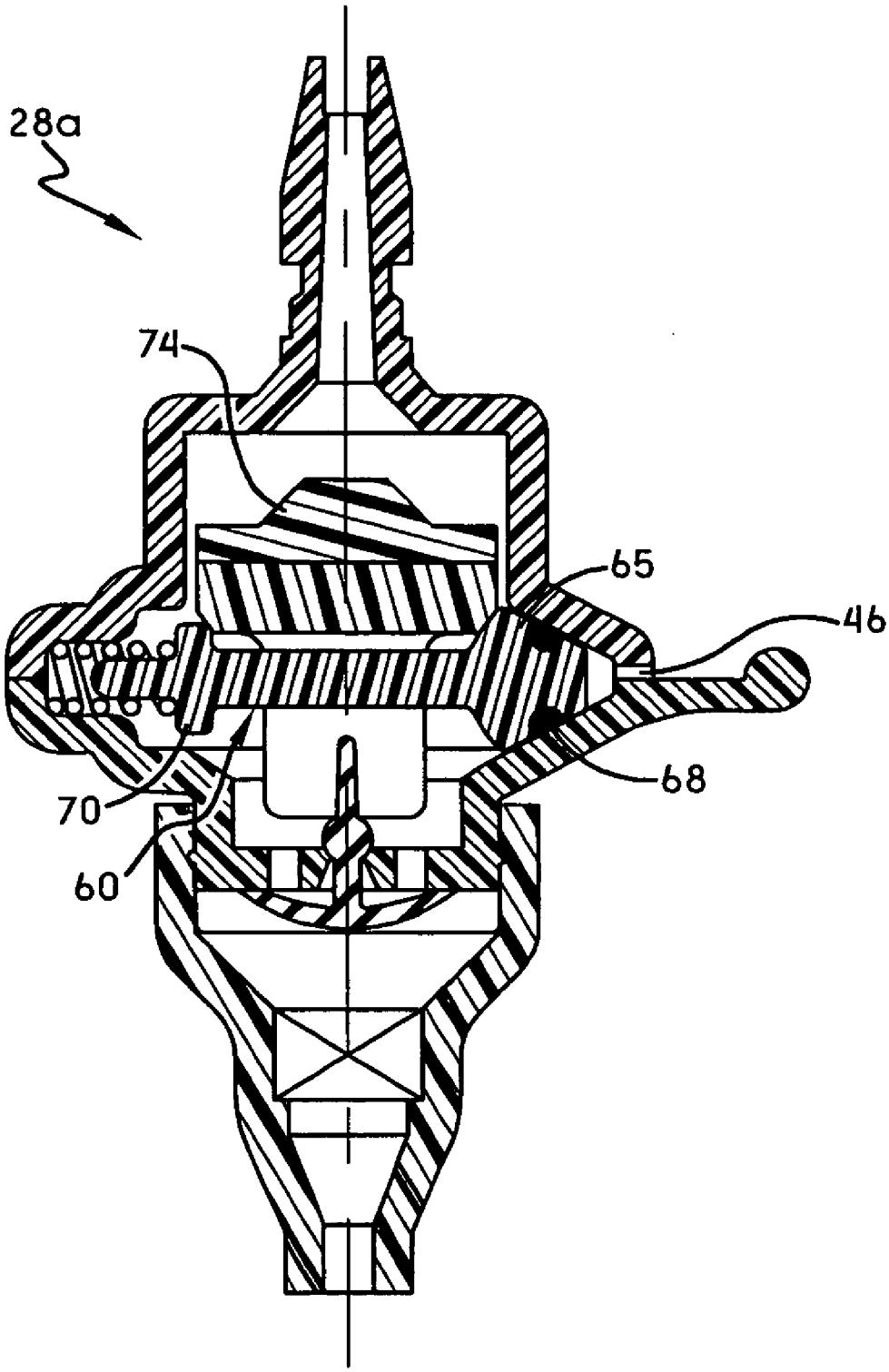
FIG. 11 is a cross section of a foam generating valve assembly as in FIG. 6, but shown empty of foamable liquid, with the float valve thereof blocking movement of the air inlet valve.

With the push bar 16 pushed inwardly as at FIG. 8, to cause the dispensing just disclosed, it should be appreciated that the contents of the holding chamber 38 of the second foam generating valve 28*b* is emptied of foamable liquid. As a result, the float valve 62 descends in the holding chamber 38 and no longer blocks the liquid inlet 52. Foamable liquid S is therefore gravity fed into the holding chamber 38, and the foamable liquid S continues to be fed until the float valve 62 again blocks the liquid inlet 52. Once the holding chamber 38 is refilled, the push bar 16 may be pushed to again cause the dispensing of a dose of foam product. This process can be repeated so long as there is a sufficient amount of foamable liquid S to enter the holding chamber 38 and raise the float valve 62 sufficiently above the air inlet valve 60. Without a sufficient amount of foamable liquid S to fill the holding chamber 38 in this manner, the valve head 74 of the float valve 62 will remain the sunken position shown in FIG. 11, where the valve head 74 of the float valve 62 engages the valve head 65 of the air inlet valve 60, preventing movement of the valve head 65 away from the interior side wall 66 of the valve engaging extension 48. With the float valve 62 in this position, a space cannot be created between the valve head 65 and the interior side wall 66, and air can not be introduced into the holding chamber 38. Thus, with reference to FIG. 3, if it is assumed that the liquid container 28*a* is sufficiently empty of foamable liquid S, such that the holding chamber 38 is not filled with foamable liquid S to raise the float valve 62, it would not be possible to compress the collapsible air chamber 41 of the valve assembly actuator mechanism 24. This is an intended consequence of having an empty container, because it serves to force the valve assembly actuator mechanism 24 to pivot at pivot structure 30 to engage a full or at least partially full first refill unit 18*a*.

Figure 9:
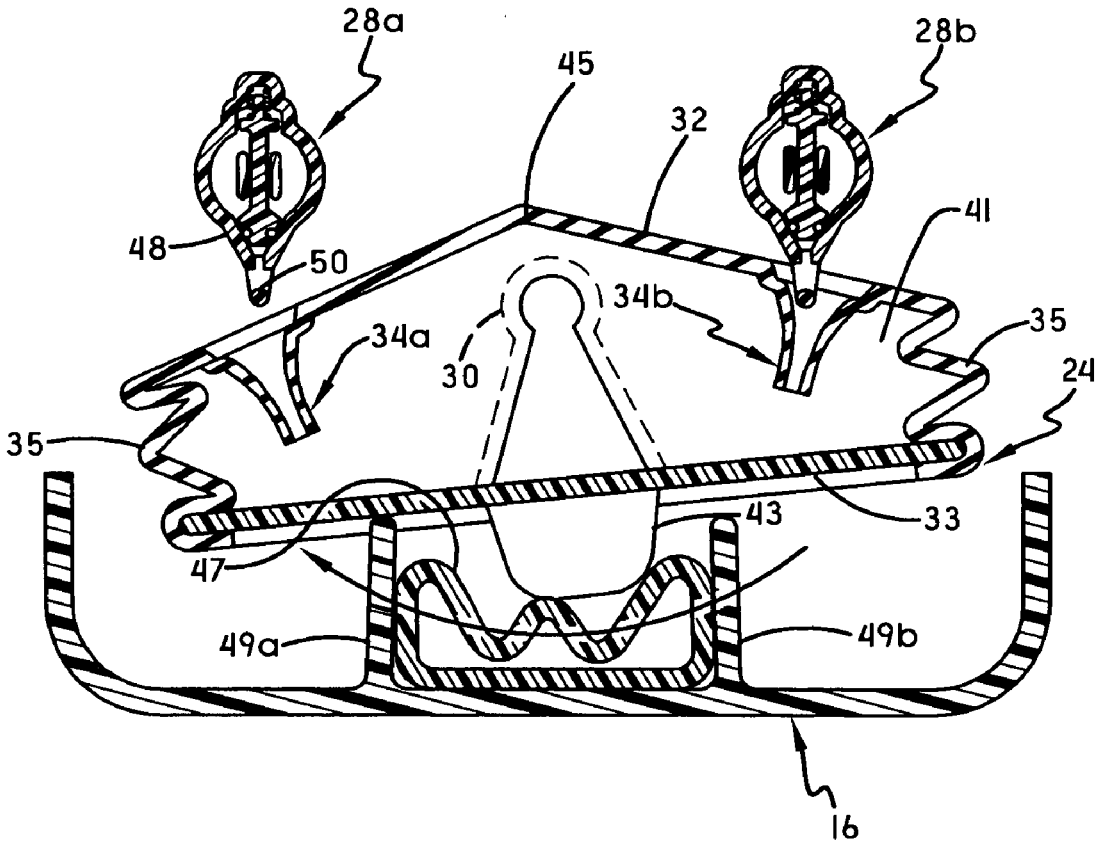
FIG. 9 is a cross section as in FIG. 3, shown with the push bar being pushed to effect the transfer of the valve assembly actuator mechanism from association with an empty refill unit to a full or partially full refill unit.

With reference to FIGS. 9 and 10 the switching of the valve assembly actuator mechanism 24 from a substantially empty refill unit 18*b* to a suitably full first refill unit 18*a* is now disclosed. In this description, it is assumed that the float valve 62 of the second foam generating valve assembly 28*b* is in the position shown in FIG. 11, blocking the movement of the air inlet valve 60. It is also assumed that the valve assembly actuator mechanism 24 is associated with the foam generating valve assembly 28*b* of that refill unit 18*b*, as shown in FIGS. 3 and 9. Pressing on the push bar 16 will not compress the collapsible air chamber 41 because the valve 60 cannot be forced away from the interior side wall 66. Instead, as seen in FIGS. 9 and 10, the arm 49*a* will push on the front wall 33 of the valve assembly actuator mechanism 24 as the push bar 16 is pressed, and the actuator knob 43 will press against the knob spring 47, causing it to compress as seen in FIG. 9. The pressure of arm 49*a* on front wall 33 will cause the valve assembly actuator mechanism 24 to pivot on the pivot structure 30, until the outlet valve 34*a* engages the foam generating valve assembly 28*a* of the first refill unit 18*a*. Assuming that refill unit 18*a* has a sufficient amount of foamable liquid S to float the float valve 62 above the air inlet valve 60, further pushing on push bar 16 will cause the collapsible air chamber 41 to compress, forcing the air therein into and through the foam generating valve assembly 28*a*, substantially as already disclosed with respect to the foam generating valve assembly 28*b*. While the valve assembly actuator mechanism 24 is associated with the first refill unit 18*a*, the second refill unit 18*b* may be replaced, and the operation of the dispenser 10 need not be interrupted. The push bar 16 may be continually compressed to dispense foam out of the foam generating valve assembly 28*a* until such time as there is insufficient foamable liquid S to raise the float valve 62 to a position permitting movement of the air inlet valve 60.

It will be appreciated that this invention advances the art by providing a product dispenser is easier to service with respect to it ensuring that the dispensing mechanisms are always associated with a full or partially full refill unit. While it is still possible for both of the refill units to be empty, the likelihood of this occurring is decreased because a maintenance worker can replace an empty refill unit while the dispensing mechanisms are associated with a full or partially full refill unit. Additionally, the invention advances the art by providing a product dispenser wherein the dispensing mechanisms automatically switched to associate with a full or partially full refill unit. The foam generating valve assemblies are also novel structures providing functionalities hereto for unknown in the art.

It should be appreciated that the various modifications made be made to the product dispenser of this invention without departing from the general teaching herein. For example, the bellows-type structure of the valve assembly actuator mechanism 24 may be replaced with a different type of collapsing structure, so long as the collapsing of that structure is capable of forcing air into a foam generating valve assembly. Additionally, the foam generating valve assemblies do not have to be foam generators, although that is the particular focus of this invention. More particularly, the foam-generating mesh, screen or cartridge could be omitted and replaced with a suitable outlet blocking valve. In such an instance, the actuation of the dispenser would simply cause air to be forced into the valve assembly (which is no longer foam-generating), with the air then forcing the liquid product out at the outlet.

In light of the foregoing, it should be appreciated that the present invention significantly advances the art by providing a dispenser that automatically switches between multiple product sources, switching to a non-empty product source the product source with which it is associated becomes significantly empty. While a particular embodiment of the invention has been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A refill unit for a product dispenser comprising:
a container holding a liquid product for dispensing; and
a valve assembly including:
a valve body,
a holding chamber in said valve body,
an air inlet providing fluid communication between a source of pressurized air and said holding chamber;
an air inlet valve normally biased by a biasing mechanism to block said air inlet and movable against the biasing force of said biasing mechanism by pressurized air introduced through said air inlet,
a liquid inlet providing fluid communication between the liquid product in said container and said holding chamber,
a liquid inlet float valve that floats on liquid product in said holding chamber such that it blocks said liquid inlet when said holding chamber is filled with liquid product and sinks with the level of said liquid product in said holding chamber to a valve-blocking position to block movement of said air inlet valve against said biasing force of said biasing mechanism.

2. The refill unit as in claim 1, wherein the valve assembly is a foam generating valve assembly, wherein air and liquid mix to form a foam.

3. The refill unit as in claim 2, wherein said liquid product is gravity fed to said holding chamber of said foam generating valve assembly.

4. The refill unit as in claim 1, wherein pressurized air introduced at said air inlet moves said air inlet valve to unblock said air inlet and permit the entrance of air into said holding chamber, when said liquid inlet float valve floats above said valve-blocking position.

5. The refill unit of claim 1, further comprising a post mix chamber, and a holding chamber outlet valve regulating the flow of said liquid product or air or both to said post mix chamber.

6. The refill unit of claim 5, further comprising a foam media in said post mix chamber.

7. The refill unit of claim 6, wherein said foam media is selected from a mesh, as screen and a open cell foam material.

8. A dispenser comprising:
a housing;
a first refill unit removably received in said housing and including:
a first container holding a liquid product for dispensing, and
a first valve assembly including:
a first valve body,
a first holding chamber in said first valve body,
a first air inlet;
a first air inlet valve normally biased by a first biasing mechanism to block said first air inlet and movable against the biasing force of said first biasing mechanism by pressurized air introduced through said first air inlet,
a first liquid inlet providing fluid communication between the liquid product in said first container and said first holding chamber,
a first liquid inlet float valve that floats on liquid product in said first holding chamber such that it blocks said first liquid inlet when said first holding chamber is filled with liquid product and sinks with the level of said liquid product in said first holding chamber to a valve-blocking position to block movement of said first air inlet valve against said biasing force of said first biasing mechanism
a second refill unit including:
a second container holding a liquid product for dispensing, and
a second valve assembly including:
a second valve body,
a second holding chamber in said second valve body, a second air inlet;

a second air inlet valve normally biased by a second biasing mechanism to block said second air inlet and movable against the biasing force of said second biasing mechanism by pressurized air introduced through said second air inlet, a second liquid inlet providing fluid communication between the liquid product in said second container and said second holding chamber, a second liquid inlet float valve that floats on liquid product in said second holding chamber such that it blocks said second liquid inlet when said second holding chamber is filled with liquid product and sinks with the level of said liquid product in said second holding chamber to a valve-blocking position to block movement of said second air inlet valve against said biasing force of said second biasing mechanism; and a valve assembly actuator mechanism mounted to said housing to selectively fluidly communicate with said first valve assembly and said second valve assembly, wherein, when said valve assembly actuator mechanism fluidly communicates with said first valve assembly, actuation of said valve assembly actuator mechanism causes product to be advanced through said first valve assembly, wherein said valve assembly actuator mechanism remains fluidly communicating with said first valve assembly until such time as said first container is empty of product, the emptying of said first container causing said first float valve to block the fluid communication between said valve assembly actuator mechanism and said first valve assembly, and wherein, when said first container is empty and said first float valve blocks the fluid communication between said valve assembly actuator mechanism and said first valve assembly, actuation of said valve assembly actuator mechanism causes it to move to fluidly communicate with said second valve assembly.

* * * * *